US008193801B2

(12) United States Patent
Illipe et al.

(10) Patent No.: US 8,193,801 B2
(45) Date of Patent: Jun. 5, 2012

(54) METHOD AND A DEVICE FOR FEEDING DC POWER TO AN AMPLIFIER MODULE FOR A PULSED LOAD

(75) Inventors: Hannes Illipe, Fjärås (SE); Wolfgang Staberg, Sandared (SE)

(73) Assignee: Saab AB (SE)

( * ) Notice: Subject to any disclaimer, the term of this patent is extended or adjusted under 35 U.S.C. 154(b) by 573 days.

(21) Appl. No.: 12/399,511

(22) Filed: Mar. 6, 2009

(65) Prior Publication Data

US 2009/0261799 A1 Oct. 22, 2009

(30) Foreign Application Priority Data

Apr. 17, 2008 (EP) ..... 08154673

(51) Int. Cl.
*G05F 5/08* (2006.01)
*G05F 1/565* (2006.01)

(52) U.S. Cl. ..... 323/299; 323/275; 327/111

(58) Field of Classification Search ..... 323/273, 323/274, 299, 908, 275, 288; 361/93.9; 327/100, 327/111, 164
See application file for complete search history.

(56) References Cited

U.S. PATENT DOCUMENTS 3,538,424 A 11/1970 Frederiksen
5,164,892 A * 11/1992 Kimbara ..... 363/131
6,774,719 B1 * 8/2004 Wessel et al. ..... 330/136
7,449,870 B2 * 11/2008 Cebry ..... 323/285
7,453,306 B2 * 11/2008 Baumgartner et al. ..... 327/307
7,893,668 B2 * 2/2011 Zolfaghari ..... 323/266
2005/1018549 8/2005 Zhang
2007/0279819 A1 12/2007 Schopfer

FOREIGN PATENT DOCUMENTS

WO WO-99/52023 A1 10/1999

OTHER PUBLICATIONS

"European Application Serial No. 08154673.1, European Search Report mailed Aug. 29, 2008", 9 pgs.
De Diego, J. M., et al., "Improvements of Power Supply Systems in Machine to Machine Modules and Fixed Cellular Terminals with Discountinuous Current Consupmtion", *IEEE International Conference on Industrial Technology* (ICIT 2006), (2006), 2575-2580.

* cited by examiner

*Primary Examiner* — Gary L Laxton
(74) *Attorney, Agent, or Firm* — Schwegman, Lundberg & Woessner, P.A.

(57) ABSTRACT

A method for feeding DC power to an amplifier module for a pulsed load, the method comprising providing current pulses from a DC power supply; charging a capacitor configuration in the amplifier module; providing an output voltage via a voltage regulated power supply; feeding current pulses to the pulsed load from the capacitor configuration, determining an output current (Iout) pulse configuration appearing during feeding the load from the capacitor configuration; providing a pulsed input current (Iin) from the DC power supply based upon the determined output pulsed current; and limiting the maximum current level of the input current pulses to a predetermined level by a control and pulse shaping circuit to be substantially lower compared to the peak current of the output current pulses.

14 Claims, 3 Drawing Sheets

METHOD AND A DEVICE FOR FEEDING DC POWER TO AN AMPLIFIER MODULE FOR A PULSED LOAD

RELATED APPLICATION

This application claims priority under 35 U.S.C. 119 to European Patent Application No. EPO 08154673.1, filed 17 Apr. 2008, which application is incorporated herein by reference and made a part hereof.

BACKGROUND

Feeding of DC power to multiple amplifier modules in antenna arrays consisting of several elements is difficult especially when there are large variations in the current consumption, as is the case in a pulsed radar application.

A common implementation is feeding the voltage via a voltage regulated power supply to the pulsed load.

Previously known techniques of substantially the kind described, offers problems in the form of high levels of current ripple on the feeding power lines due to the pulsed current. Further, the pulsed current with extensive rise and fall during short time periods, causes EMI to other parts of the system. Still further, the power supply need to be designed to handle the peak current load.

OBJECT OF THE INVENTION

The object of one or more embodiments of the present invention is to provide a solution to the problems described above by providing, inter alia, a reduced EMI disturbance and reduced DC power supply current rating as far as peak currents are concerned.

SUMMARY OF THE INVENTION

This and other objects of the embodiments of the present invention are obtained by one or more methods, and one or more devices, according to the claims in the application.

Further advantages are obtained by the subject matter included one or more of the claims in the application.

BRIEF DESCRIPTION OF THE DRAWINGS

A better understanding of the present invention should be had based upon the following detailed description read in conjunction with the attached drawings, wherein FIG. 1 schematically shows a block diagram over a first embodiment of a current/voltage regulator configuration according to the present invention.

DETAILED DESCRIPTION OF PREFERRED EMBODIMENTS

Figure 1:
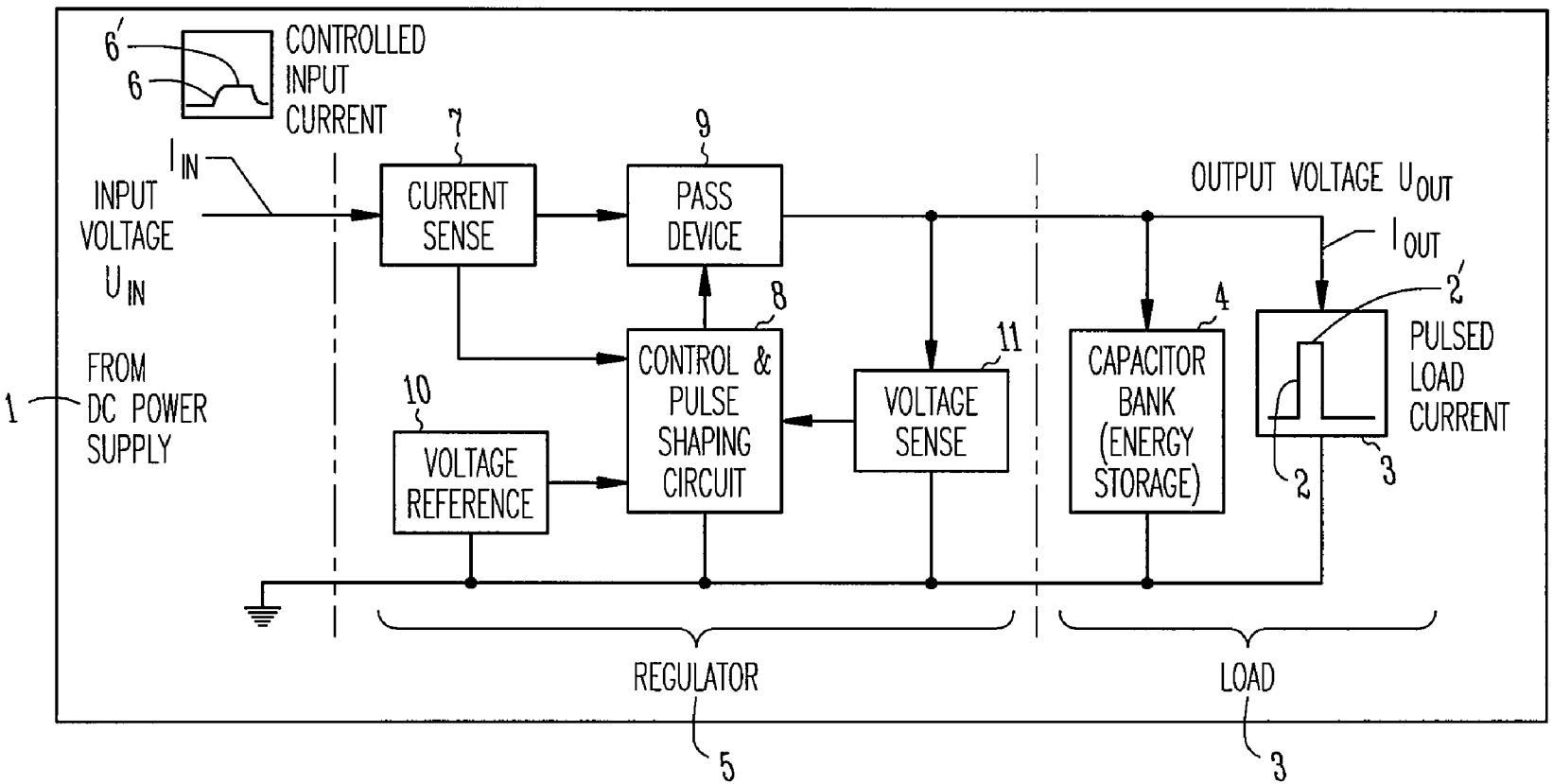

In FIG. 1 a DC power supply 1 is arranged for providing DC power for output current pulses 2 to a pulsed load 3. 4 designates a capacitor configuration or capacitor bank for energy storage, the capacitor configuration being arranged for feeding current pulses 2 to said load 3.

An output voltage $U_{out}$ is provided via a current/voltage regulator configuration 5 between the DC power supply 1 and the load 3.

The energy of the output current pulses 2 fed to the load, ie required by the load, corresponds substantially to the energy of the input current pulses 6 provided from the DC power supply 1, a slight difference, however, appearing due to minor energy losses in the current/voltage regulator configuration 5. The energy of the output pulses is determined and, thus, known.

As discussed above the output current pulses 2 have an unfavourable maximum current level and shape, the rise and fall times being extremely short for many applications.

Figure 2:
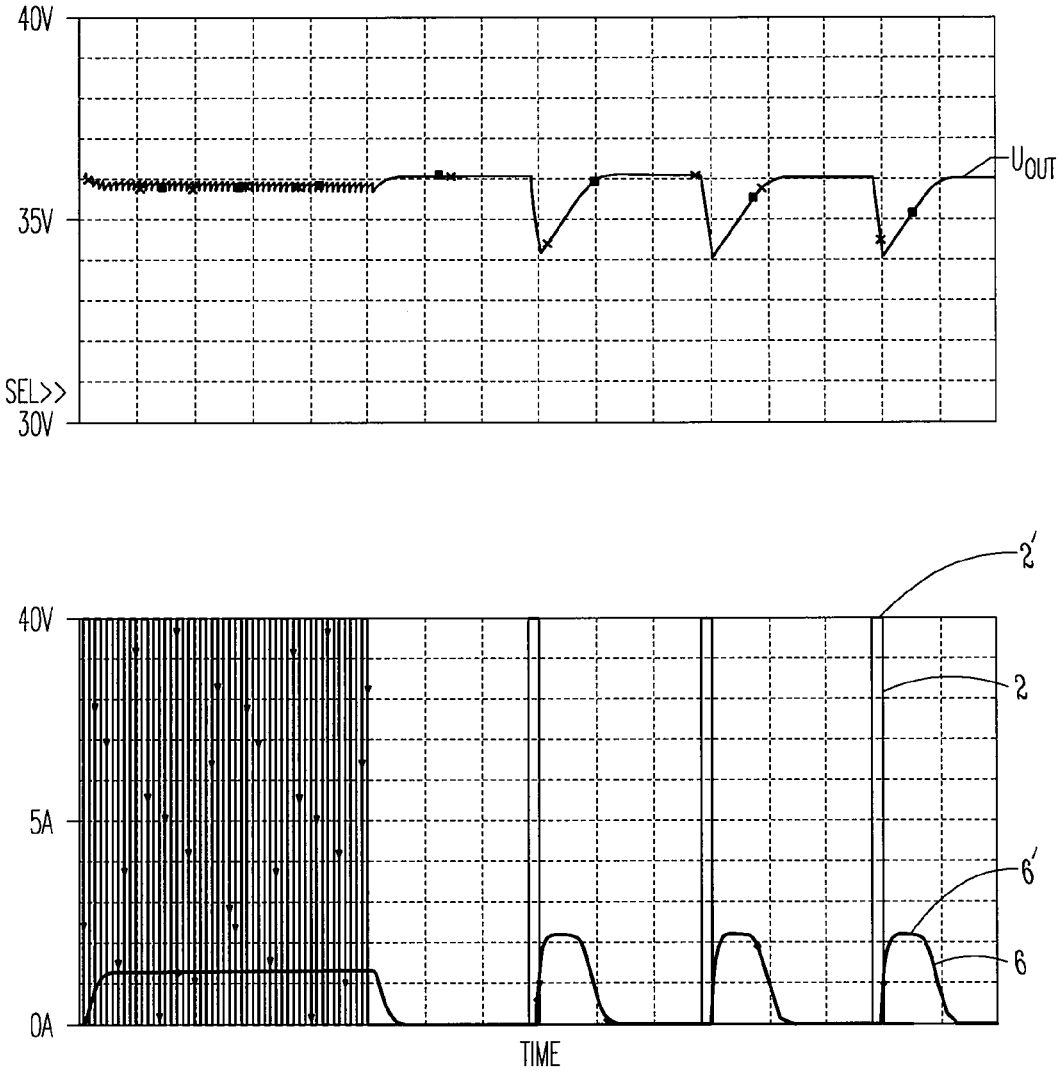
FIG. 2 schematically shows a simulation of the input and output current, and output voltage in a regulation configuration according to FIG. 1.
Figure 3:
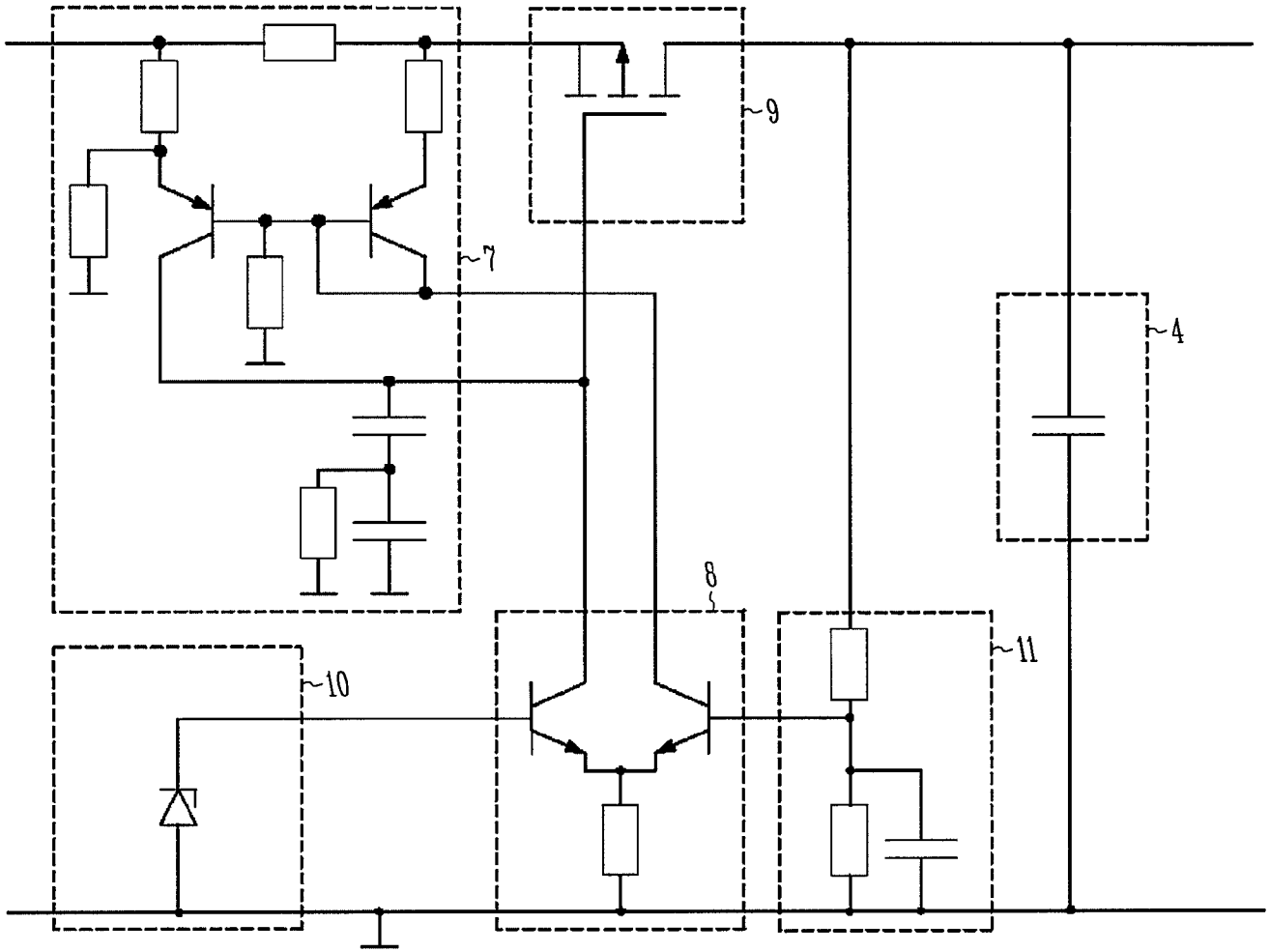
FIG. 3 schematically shows an electronic circuit according to various embodiments, wherein dashed boxes included in the figure are identified by reference numbers corresponding to the same blocks and reference numbers shown in FIG. 1.

The current/voltage regulator configuration 5 is arranged to modify the input current pulses 6, the maximum current level 6' being limited to a pre-determined level and the rise and fall times of the current pulses preferably being controlled so that the rise and fall times are longer than in the case of the output current pulses to the load, as will be further discussed in relation to FIG. 2.

The current/voltage regulator configuration 5 according to the present invention comprises a current sense arrangement 7, a control and pulse shaping circuit 8, a pass device 9, a voltage reference arrangement 10 and a voltage sense arrangement 11, the current/voltage regulator configuration being arranged to provide an output voltage $U_{out}$ from the DC power supply for charging the capacitor configuration to provide energy for start-up and successive output current pulses 2 as required by the load. Preferably, the circuit has a slow voltage regulation loop so that a stable step response without over-shoot is obtained.

In FIG. 1 the capacitor configuration 4 has been shown as associated with the load 3.

In more detail the current sense arrangement 7 comprises a modified current mirror arrangement cooperating with, in various embodiments, a power transistor of the pass device 9 and a differential amplifier arrangement of the control and pulse shaping circuit 8, the pass device being controlled to act as a variable resistance to limit the maximum current level 6' and the current mirror comprising a capacitor arrangement for controlling the rise and fall times of the input current pulses 6.

The voltage sense comprises means for regulation against a nominal output voltage by means of a feed-back reference voltage differential amplifier configuration.

FIG. 2 shows, as an example, plots from a simulation showing input and output current and output voltage behaviour vs time of the current/voltage regulator configuration during successive charging and discharging of the capacitor configuration and successive input current pulses from the power supply and successive output current pulses to the load from the capacitor configuration.

In the example the input voltage $U_{in}$ is +41 V, the voltage reference +10 V, the nominal output voltage +36 V, the maximum current level 2' of the output current pulses 2 10 A and the maximum current level of the input current 2 A.

The upper plot in FIG. 2 shows the output voltage vs time with short-/high repetition rate pulses in the left part, and long-/low repetition rate pulses to the right.

The lower plot in FIG. 2 show both the input- and output current vs time. In the left part 50 pulses of a high frequency pulse load current, short duration pulses with high repetition rate are shown, and in the right part 3 pulses of a lower frequency pulse load current, long pulses with low repetition rate are shown.

For the high repetition rate pulses in the left part, the chosen pulse length is short, and the duty cycle too low for limiting the input current. Therefore the circuit keeps regulating the output voltage, while the input current stays constant, until the high repetition rate pulses ends, and the input current drops to zero.

For the long pulses, to the right, the output voltage drops during each pulse and after a delay the input current limiter turns on to charge the output capacitor back to nominal output voltage.

Thus, energy for short 10 A output current pulses 2 discharged to the load is provided by input current pulses 6 from the power supply, the input pulses 6 being controlled and shaped by the current/voltage regulator configuration so that, in the example, the maximum current level 6' is about 2 A and the rise and fall times of the pulses 6 are much longer than those of the output current pulses 2.

The characteristics of the current/voltage regulator configuration may be controlled and amended with respect to, in various embodiments, output voltage, maximum current level and rise and fall times by means of choice of the discrete components, such as but not limited to, resistances, capacitors, transistors etc.

The method and the function of the device according to the present invention should to a considerable and sufficient extent have been made clear to a person skilled in the art from the detailed description given above.

The invention offers several advantages compared to prior art. Thus, the predetermined limited maximum current level makes it possible to make the DC power supply 1 smaller since it does not have to be designed/dimensioned to handle the peak current pulses of the load/output current. In the given example, the reduction in load- to input current is about 5:1.

Further, the shaped input pulses with longer rise and fall times reduces EMI to other parts of the system or the corresponding.

The characteristics of the current/voltage regulator configuration may easily be amended by changing discrete components.

Above the present invention has been described in conjunction with examples and preferred embodiments.

However, further embodiments as well as minor additions and amendments may be imagined without departing from the basic inventive idea.

Thus, the invention is suitable for feeding DC power to multiple amplifier modules in antenna arrays comprising several elements, such as in pulsed radar applications. However, the invention is suitable also for other applications, especially applications characterized by extensive variations as far as pulsed current consumption is concerned.

When it comes to the detailed design of, primarily, the current/voltage regulation configuration there are a number of possible solutions, specific component characteristics etc.

Thus, the inventions should not be considered to be limited to the embodiments disclosed but can be varied within the scope of the claims.

What is claimed is:

1. A method for feeding DC power to an amplifier module for a pulsed load, comprising:

providing current pulses from a DC power supply;

charging a capacitor configuration in the amplifier module;

providing an output voltage via a voltage regulated power supply;

feeding current pulses to said load from said capacitor configuration, determining an output current ($I_{out}$) pulse configuration appearing during feeding the load from said configuration;

providing a pulsed input current ($I_{in}$) from said DC power supply based upon the determined output pulsed current;

limiting the maximum current level of the input current pulses to a pre-determined level by a control and pulse shaping circuit to be substantially lower compared to the peak current of said output current pulses; and controlling the shape of the input current pulses for extending the rise and fall times of the input current pulses compared to the rise and fall times of the output current pulses.

2. The method according to claim 1, wherein the energy of the output current pulses substantially correspond to the energy of the input current pulses from said DC power supply.

3. The method according to claim 1, further including:

sensing a momentary voltage difference by a momentary voltage difference sensing configuration during creation of the input current pulses for charging said capacitor configuration.

4. The method according to claim 1, further including:

regulating against a nominal output voltage ($U_{out}$) during capacitor configuration charging by means of feed-back to a differential amplifier configuration.

5. The method according to claim 1, further including:

providing a differential amplifier arrangement and a modified current mirror for voltage regulation.

6. A method according to claim 1, further including:

controlling a pass device power transistor operation for limiting the maximum input current ($I_{in}$) level.

7. The method according to claim 1, further including:

providing a capacitor arrangement in a modified current mirror for reducing rise and fall times of the input current pulses.

8. A device for feeding DC power to an amplifier module for a pulsed load, comprising:

a DC power supply for DC current pulse supply, a capacitor configuration arranged in the module arranged to be charged, the capacitor configuration being operable to feed a pulsed current to a pulsed load, a voltage regulated power supply operable to provide an output voltage, including a current/voltage regulator configuration to provide a pulsed input current ($I_{in}$) from said DC power supply based upon a determined current ($I_{out}$) pulse configuration appearing during feeding the pulsed load from said capacitor configuration, and to limit the maximum current level of the input current ($I_{in}$) pulses to a pre-determined level, by a control and pulse shaping circuit, to be lower compared to a peak current of said determined current pulse configuration, wherein the control and pulse shaping circuit comprises means for controlling the shape of the input current pulses for extending the rise and fall times of the input current pulses compared to the rise and fall times of the output current pulses.

9. The device according to claim 8, wherein the energy of the output current pulses substantially corresponds to the energy of the input pulses from said DC power supply.

10. The device according to claim 8, further including:

a momentary voltage difference sensing configuration for sensing a momentary voltage difference during creation of the input current pulses for charging said capacitor configuration.

11. The device according to claim 8, further including:

the voltage regulated power supply for regulation against a nominal output voltage ($U_{out}$) during capacitor configuration charging including a slow voltage regulator circuit.

12. The device according to claim 8, further including:

a differential amplifier arrangement and a modified current mirror.

13. The device according to claim 8, further including:

an arrangement comprising a power transistor and means for controlling the operation of the power transistor by limiting the maximum input current level.

14. A device for feeding DC power to an amplifier module for a pulsed load, comprising:

a DC power supply for DC current pulse supply, a capacitor configuration arranged in the module arranged to be charged, the capacitor configuration being operable to feed a pulsed current to a pulsed load, a voltage regulated power supply operable to provide an output voltage, including a current/voltage regulator configuration to provide a pulsed input current ($I_{in}$) from said DC power supply based upon a determined current ($I_{out}$) pulse configuration appearing during feeding the pulsed load from said capacitor configuration, and to limit the maximum current level of the input current ($I_{in}$) pulses to a pre-determined level, by a control and pulse shaping circuit, to be lower compared to a peak current of said determined current pulse configuration, and a capacitor arrangement in a modified current mirror for controlling the rise and fall times of the input current pulses.

* * * * *